US006486403B1

(12) United States Patent
Connor

(10) Patent No.: US 6,486,403 B1
(45) Date of Patent: Nov. 26, 2002

(54) ELECTRICAL COMPRESSION CONNECTOR

(75) Inventor: Brian W. Connor, Amherst, NH (US)

(73) Assignee: FCI USA, Inc., Etters, PA (US)

( * ) Notice: Subject to any disclaimer, the term of this patent is extended or adjusted under 35 U.S.C. 154(b) by 0 days.

(21) Appl. No.: 09/902,052

(22) Filed: Jul. 10, 2001

(51) Int. Cl.[7] ..... H01R 4/00
(52) U.S. Cl. ..... 174/84 C
(58) Field of Search ..... 174/84 C, 94 R

(56) References Cited

U.S. PATENT DOCUMENTS

| | | | | | |
|---|---|---|---|---|---|
| 3,322,888 | A | * | 5/1967 | Zemels | 174/71 R |
| 5,103,068 | A | * | 4/1992 | Schrader | 174/71 R |
| 5,200,576 | A | * | 4/1993 | Schrader et al. | 174/71 R |
| 5,635,676 | A | * | 6/1997 | Piriz | 174/84 C |
| 5,898,131 | A | | 4/1999 | Chadbourne et al. | 174/84 C |
| 6,261,137 | B1 | * | 7/2001 | Wilcox | 174/84 C |

OTHER PUBLICATIONS

Web site page for YGHP58CW–2 compression ground tap connector, FCI, 1 page, No date.
Web site page for YH298CWC compression connector, FCI, 1 page, No date.
Web site page for YH298C conpression connector, FCI,1 page, No date.
Web site page for Y35 compression tool, FCI, 1 page, No date.
Web site page for Y46C compression tool, FCI, 1 page, No date.
Web site page for Y46 compression tool, FCI, 1 page, No date.
Web site page for Y750 compression toll, FCI, 1 page, No date.

* cited by examiner

*Primary Examiner*—Neil Abrams
*Assistant Examiner*—Phuong Dinh
(74) *Attorney, Agent, or Firm*—Harrington & Smith, LLP

(57) ABSTRACT

An electrical compression connector having a first section with a first main conductor receiving channel extending into a top side of the connector; and a second section integrally formed with the first section. The second section has a first tap conductor receiving channel and a second tap conductor receiving channel extending into opposite respective first and second lateral sides of the connector. The tap conductor receiving channels comprise different shapes and different cross sectional areas. Bottom portions of the second section extend laterally outward past lateral sides of the first section.

19 Claims, 5 Drawing Sheets

ELECTRICAL COMPRESSION CONNECTOR

BACKGROUND OF THE INVENTION

1. Field of the Invention

The present invention relates to electrical connectors and, more particularly, to an electrical compression connector.

2. Brief Description of Prior Developments

U.S. Pat. No. 5,898,131 discloses a twisted H-shaped electrical connector. A hydraulic compression tool can be used to compress the connector for connecting two conductors to each other at the same time. FCI USA Inc. sells electrical compression connectors under the part designation YH292C which are specifically designed for the telecommunications industry for making parallel and tap connections to copper Class I and Class K stranded conductors.

Class K conductors are more flexible than Class I conductors. This increased flexibility is provided by a substantially larger number of individual strands in the conductor. For example, a 2 AWG Class I copper stranded conductor has 161 strands and a 2 AWG Class K copper stranded conductor has 665 strands. The individual strands of a Class K conductor have a smaller diameter than the individual strands in a Class I conductor (0.01inch versus 0.201 inch). However, a Class K conductor has a larger outer diameter than a Class I conductor of the same electrical size (i.e., a 2 AWG Class K conductor has a 0.338 inch nominal diameter, and a 2 AWG Class I conductor has a 0.319 inch nominal diameter).

For the YH292C connector, the largest tap conductor receiving channel can accept and be properly crimped onto a Class I conductor between 2–6 AWG or a Class K conductor between 3–8 AWG. The YH292C connector cannot be properly crimped onto a 2 AWG Class K conductor at its largest tap conductor receiving channel. The largest tap conductor receiving channel is too small to properly receive and connect to the larger diameter Class K conductor. Although a 2 AWG Class K conductor can be placed inside the largest tap conductor receiving channel of the conventional YH292C compression connector, during compression strands of the Class K conductor are pushed out of the lateral side aperture of the tap conductor receiving channel before the aperture is closed. This creates a problem electrically due to the small percentage of strands actually contained in the compressed conductor tap receiving channel. These non-contained stands can also contact and thereby cause problems with nearby electrical or electronic components. In addition, these strands can break off of the conductor and cause additional problems with nearby electrical or electronic components. , The smaller tap conductor receiving channel for the YH292C connector can accept and be properly crimped onto a Class I conductor between 8–14AWG or a Class K conductor between 10–14 AWG. The YH292C connector cannot be properly crimped onto an 8 AWG Class K conductor at its smaller tap conductor receiving channel. The smaller tap conductor receiving channel is too small to properly receive and connect to the larger diameter Class K conductor. Although an 8 AWG Class K conductor can be placed inside the smaller tap conductor receiving channel of the conventional YH292C compression connector, during compression strands of the Class K conductor are pushed out of the lateral side aperture of the tap conductor receiving channel before the aperture is closed.

There is a desire to provide an electrical compression connector with tap conductor receiving channels which can be used with Class I and Class K conductors having the same electrical wire size. There is also a desire to provide an electrical compression connector adapted to be connected to a Class I conductor or a Class K conductor of the same size and can be compressed onto the Class K conductor without strands of the conductor being pushed out of a lateral side aperture into the tap conductor receiving area before the aperture is closed.

SUMMARY OF THE INVENTION

In accordance with one aspect of the present invention, an electrical compression connector is provided having a first section with a first main conductor receiving channel extending into a top side of the connector; and a second section integrally formed with the first section. The second section has a first tap conductor receiving channel and a second tap conductor receiving channel extending into opposite respective first and second lateral sides of the connector. The tap conductor receiving channels comprise different shapes and different cross sectional areas.

In accordance with another aspect of the present invention, an electrical compression connector is provided including a first section having a first main conductor receiving channel extending into a top side of the connector; and a second section integrally formed with the first section. The second section has a first tap conductor receiving channel and a second tap conductor receiving channel extending into opposite respective first and second lateral sides of the connector. The tap conductor receiving channels comprise different shapes or sizes, and bottom portions of the second section extend laterally outward past lateral sides of the first section.

In accordance with another aspect of the present invention, an electrical compression connector is provided including a first section having a first main conductor receiving channel extending into a top side of the connector; and a second section integrally formed with the first section. The second section has a first tap conductor receiving channel and a second tap conductor receiving channel extending into opposite respective first and second lateral sides of the connector. Lateral sides of bottom portions of the second section extend laterally outward past lateral sides of top portions of the second section. The first tap conductor receiving channel is sized and shaped to fully crimp onto a 2 AWG size Class K conductor. The second tap conductor receiving channel is sized and shaped to fully crimp onto an 8 AWG size Class K conductor. The second section is about 1 inch wide or less and, less than about 0.7 inch high.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
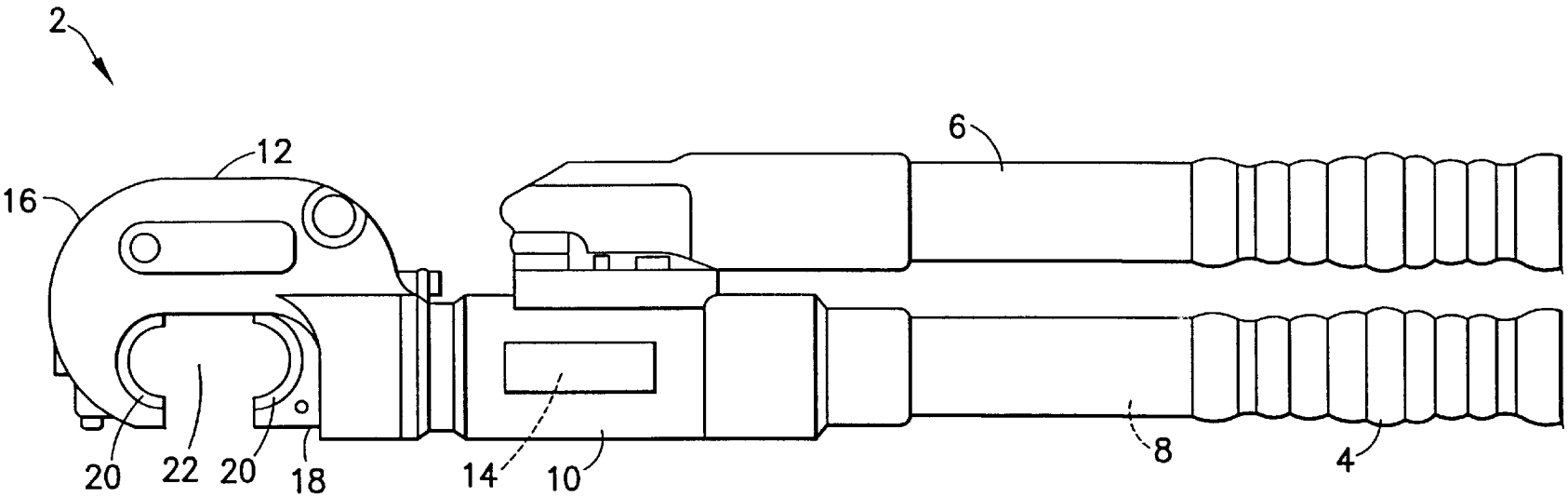
FIG. 1 PRIOR ART
FIG. 1 is an elevational side view of a conventional hydraulic hand operated connector compression tool.

Referring to FIG. 1, there shown an elevational side view of a conventional hydraulic tool 2 used to compress electrical compression connectors onto electrical conductors. One such tool is sold by FCI USA Inc. under the part designation Y750. However, the electrical connector of the present invention could be compressed onto electrical conductors by any suitable type of compression tool. For example, another such tool is sold by FCI USA Inc. under the part designation Y46.

The tool 2 shown in FIG. 1 generally comprises a first handle 4 having a fluid reservoir 8 therein, a second handle 6, a body 10 and a compression head 12. A hydraulic pump 14 is located inside the body 10. The compression head 12 generally comprises a frame 16 and a movable ram 18. The ram 18 is moved forward on the frame 16 by hydraulic pressure from hydraulic fluid delivered from the pump 14. The frame 16 and the ram 18 are each adapted to removably receive a crimping die 20. A connector receiving space 22 is formed between the two crimping dies 20. When the ram is advanced to move the two dies 20 towards each other, a connector located between the two dies is compressed or crimped.

Figure 2:
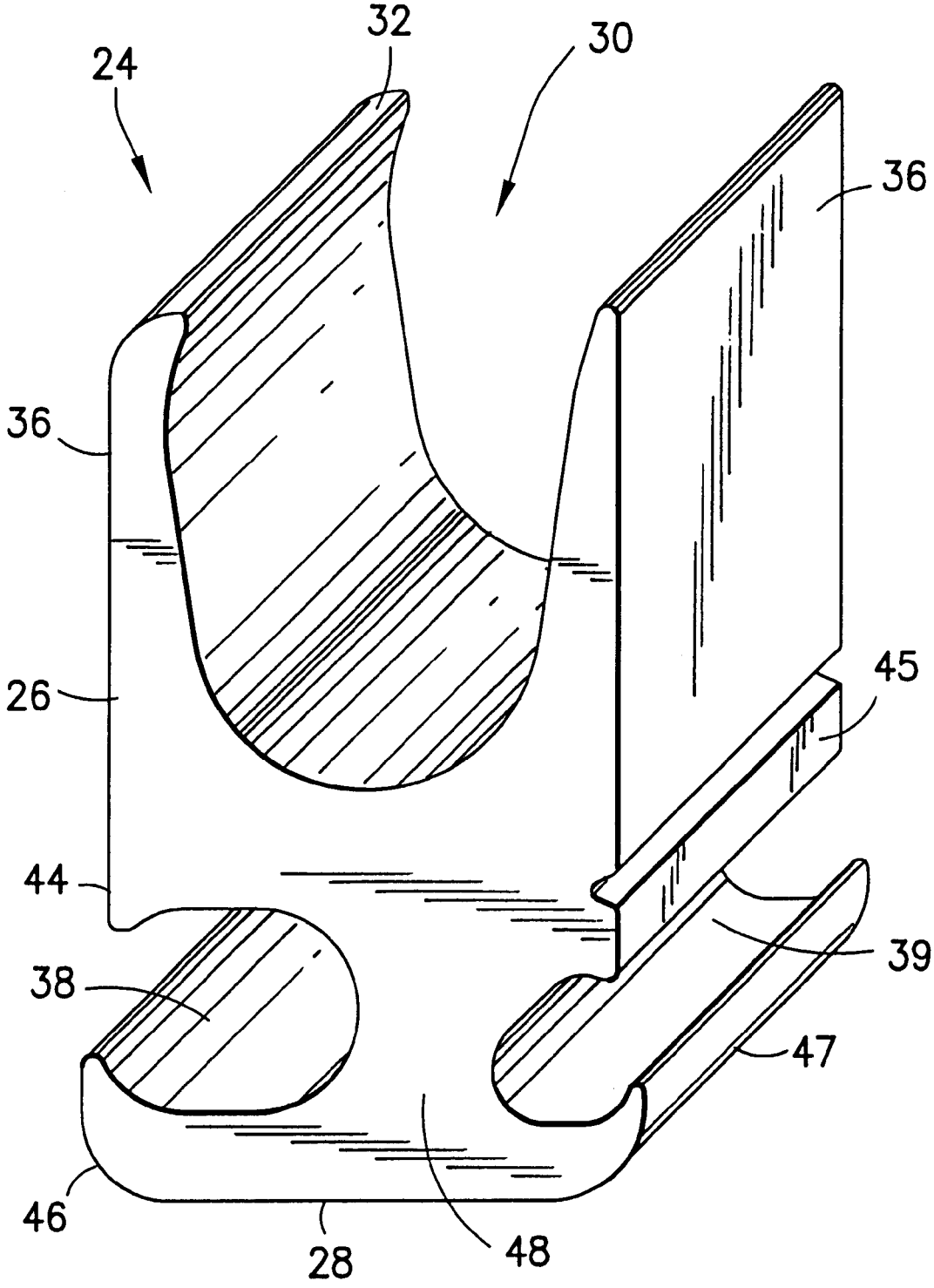
FIG. 2 is a perspective view of an electrical compression connector incorporating features of the present invention.
Figure 3:
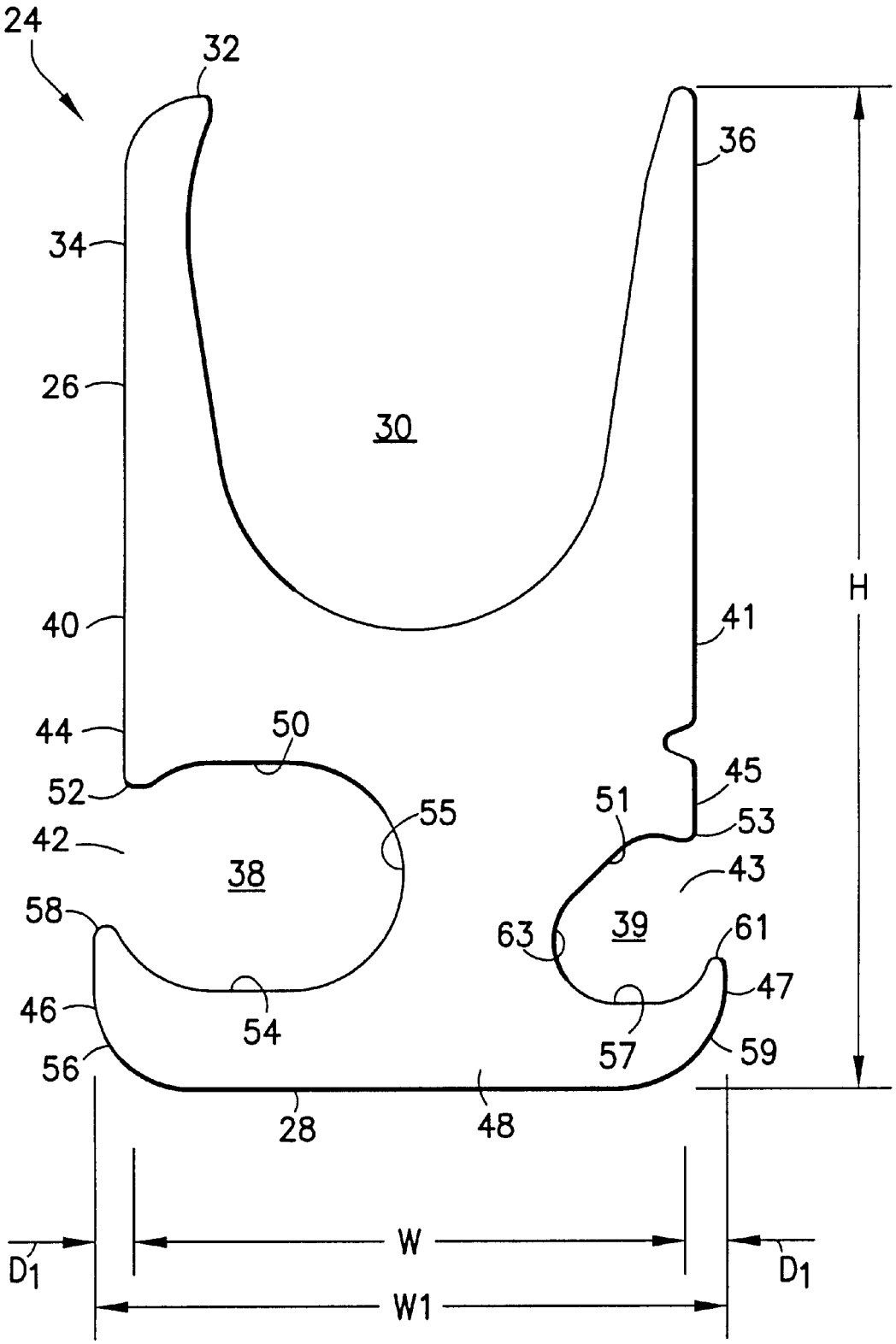
FIG. 3 is a front elevational view of the connector shown in FIG. 2.

Referring to FIGS. 2 and 3, there are shown a perspective view and a front elevational view of an electrical compression connector 24 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

The connector 24 comprises a one-piece member. The one-piece member is preferably comprised of metal, such as copper. However, the one-piece member could be comprised of multiple components and/or could be comprised of any suitable materials, such as aluminum. The one-piece member is preferably an extruded member. However, any suitable type of method for manufacturing the one-piece member could be provided.

The connector 24 generally comprises a first section 26 and a second section 28. In this embodiment, the first section 26 is a top section of the connector and the second section 28 is a bottom section of the connector. The two sections 26,28 are preferably integrally formed with each other during the extrusion process. Because the connector 24 is preferably manufactured by an extrusion process, the connector has a substantially uniform cross-section along its length. However, in alternate embodiments, the connector 24 could have sections along its length which do not have a uniform cross-section.

The top section 26 has a first conductor receiving channel 30 extending into a first top side 32 of the connector. The top section 26 has a general U-shaped profile. A first leg 34 has a curved top end. A second leg 36 has a relatively tapered or pointed top end. However, in alternate embodiments, the top section 26 and the legs 34, 36 could have any suitable type of shape.

The bottom section 28 has a first tap conductor receiving channel 38 and a second tap conductor receiving channel 39. The two tap channels 38, 39 have different shapes. This provides the bottom section 28 with an asymmetrical shape. The three conductor receiving channels 30, 38 and 39 extend generally parallel to each other. In alternate embodiments, more or less than two tap conductor receiving channels could be provided. The two tap conductor receiving channels 38, 39 extend into respective opposite lateral sides 40, 41 of the connector. Each tap channel 38, 39 has an aperture 42, 43 at its respective lateral side 40, 41. At each tap channel, the bottom section 28 comprises respective top portions 44, 45 and bottom portions 46, 47. A middle section 48 is located between the two tap channels 38, 39.

The first tap channel 38 has a general oval shaped cross section with the aperture 42 at one side. However, in alternate embodiments, the first tap channel could have any suitable shape. The top portion 44 has a flat surface 50, and a protrusion 52 at a junction of the surface 50 with the lateral side 40. The protrusion 52 projects in a general downward direction towards the bottom portion 46. The bottom portion 46 has a flat upper surface 54 and a curved outer end 56 with a tip 58. The inner side surface 55 is generally curved. In alternate embodiments, the surfaces 50, 54, 55 could have any suitable shape. In a preferred embodiment, the first tap channel 38 has a height of about 0.345 inch and a depth between the surface 55 and the outer side of the tip 58 of about 0.48 inch. The radius of curvature of the inner curves at the side 55 is about 0.16 inch. However, any suitable dimensions could be provided.

The second tap channel 39 has a general wedge shaped cross section with the aperture 43 at one side. However, in alternate embodiments, the second tap channel could have any suitable shape. The top portion 45 has a flat surface 51 at an upper oblique side, and a protrusion 53 at a junction with the lateral side 41. The protrusion 53 projects in a general downward direction towards the bottom portion 47. The bottom portion 47 has a flat upper surface 57 and a curved outer end 59 with a tip 61. In alternate embodiments, the surfaces 51, 57 could have any suitable shape. In a preferred embodiment, the second tap channel 39 has a height of about 0.25 inch, a depth between its inner most surface and the outer side of the tip 61 of about 0.275 inch, and the oblique side 51 is angled relative to the surface 57 at an angle of about 50°. The radii of curvature for the curves in the channel 39 is about 0.09 inch. However, any suitable dimensions and angle could be provided.

The middle section 48 has a substantially flat bottom surface. The bottom of the second section 28, thus, has a substantially flat bottom surface with an upward curved section at each of the bottom portions 46, 47. The curved outer ends 56, 59 extend upward and also project laterally outward past the lateral sides 40,41 of the first section 26 and the lateral side of the top portions 44, 45 of the second section 28 as indicated by distances $D_1$.

In a preferred embodiment, the connector 24 has a height H which is about 1.525 inches, and a width W between the lateral sides 40, 41 at the top section 26 which is about 0.9 inch. However, in alternate embodiments, the connector could have any suitable height and width. These dimensions (H and W) and the shape of the top section 26 are substantially the same as an existing conventional electrical compression connector sold by FCI USA Inc. under the part designation YH292C. However, the YH292C electrical compression connector does not comprise outwardly projecting tips at the bottom sides of its second conductor receiving channels.

The connector 24 differs from the YH292C compression connector in two main respects. First, the tap conductor receiving channels 38, 39 have different shapes than in the conventional connector. Second, the bottom section 28 has the two bottom curved portions 46, 47 which extend laterally outward past the lateral sides of the top portions 44, 45 and the first section 26. In the preferred embodiment, the width W1 between the outer lateral sides of the bottom portions 46, 47 which is about 1 inch, and the distances $D_1$ are each preferably about 0.05 inch. However, in alternate embodiments, any suitable distances could be provided for W1 and $D_1$. The distances $D_1$ at each side could also be different from each other. The combination of these two features provides a new and improved electrical compression connector which has numerous advantages.

The conventional YH292C electrical compression connector is adapted to connect to Class I copper stranded conductor with a main run wire size (in its main conductor receiving area) between 2 AWG and 250 kcmil, and a first tap wire size (in its larger tap conductor receiving area) between 2–6 AWG, and a second tap wire size (in its smaller tap conductor receiving area) between 8–14 AWG. The connector 24 is sized and shaped to connect to the same range of Class I copper conductors as the conventional YH292C electrical compression connector. However, the connector 24 is also sized and shaped to connect to the same range tap electrical sizes with the larger outer diameter Class K stranded conductors.

When the conventional YH292C electrical compression connector was attempted to be connected to a 2 AWG Class K stranded conductor in the first tap channel or an 8 AWG Class K stranded conductor in the second smaller tap channel, strands of the Class K conductor projected out of the tap channels and were not completely captured in the tap channels. This caused problems as noted above. The present invention overcomes these problems. The present invention allows all the strands of the Class K conductor to be retained in the tap channels 38, 39 during compression of the connector 24. This feature is provided by the combination of the increased size of the tap channels, the shape of the tap channels, and the extended shape of the bottom portions 46, 47.

Figure 4:
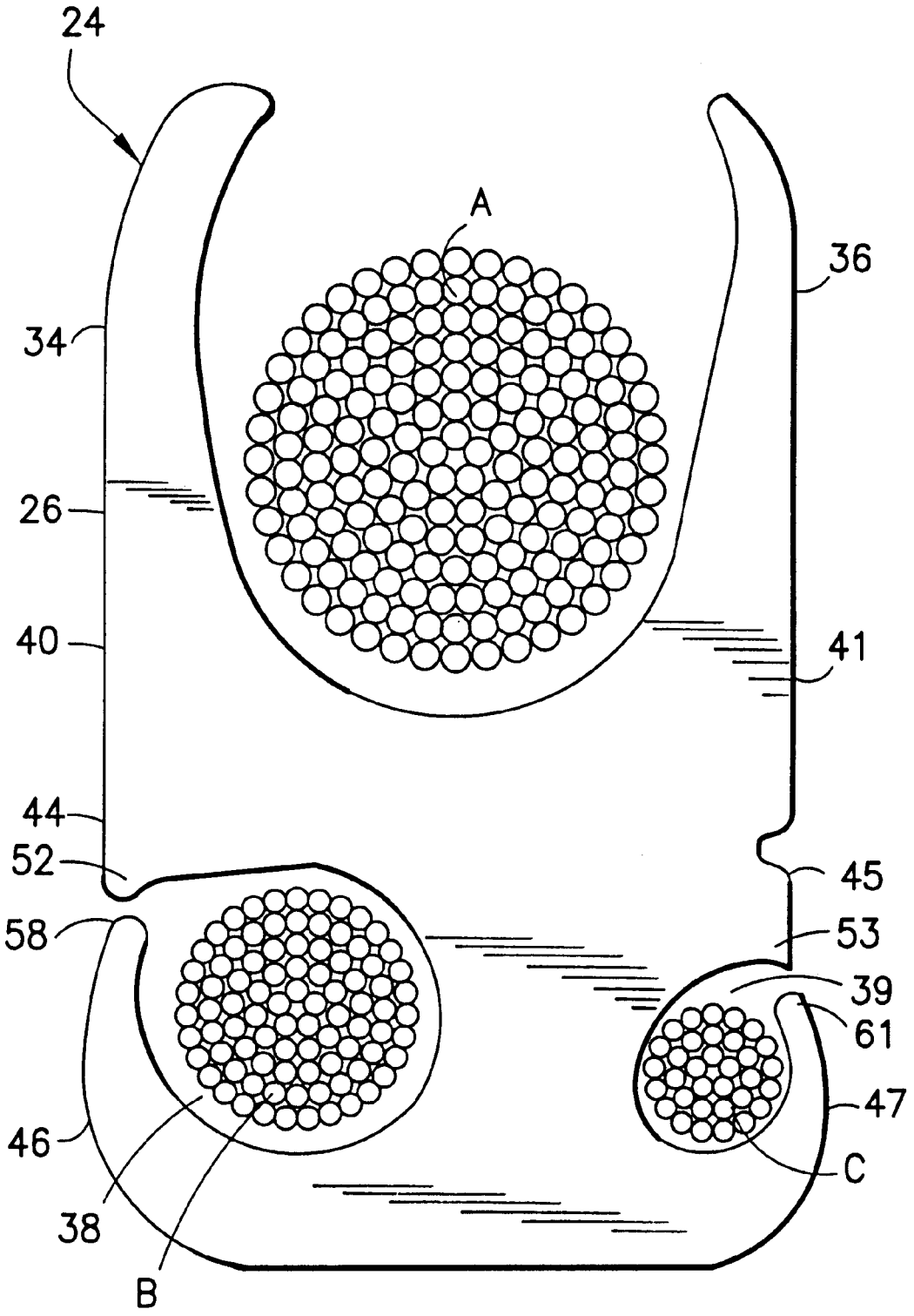
FIG. 4 is a front elevational view of the connector shown in FIG. 3 and three conductors with the connector partially crimped onto the conductors.

Referring also to FIG. 4, the connector 24 is shown at a partially crimped condition onto a main conductor A and two tap conductors B, C. With the present invention, during the compression or crimping process, the bottom portions 46, 47 are deformed upward and inward to contact the projections 52, 53 of the top portions 44, 45. This closes the lateral side apertures 42, 43 into the tap channels 38, 39. The deformation of the bottom portions 46–47, to close the lateral side apertures 42–43, is completed before substantial compression of the main conductor A in the top section 26 occurs. In other words, the closing of the lateral side apertures 42, 43 occurs at an early stage during the connector compression process.

This early stage closing of the lateral side apertures 42, 43 prevents strands of the Class K conductor from exiting the apertures 42, 43 during crimping. This is because the apertures 42, 43 are closed before the Class K tap conductors B, C in the tap channels 38, 39 are exposed to substantial compression. Therefore, compressive forces acting upon the tap conductors B, C before the apertures 42, 43 close are insufficient to force strands of the tap conductors B, C out of the apertures 42, 43.

The oblong or oval shape of the first tap channel 38 provides enough space in the channel 38 for the tap conductor B to move backward against the surface 55, and away from the aperture 42, to allow the aperture 42 to close before the strands of the tap conductor B might start to otherwise spray outward. The wedge shape of the second tap channel 39 provides enough space in the channel 39 for the tap conductor C to move backward against the surface 63, and away from the aperture 43, to allow the aperture 43 to close before the strands of the tap conductor C might start to otherwise spray outward. The oblique surface 51 can function as a wedge to wedge the strands inward and downward as the bottom portion 47 moves upward. With the apertures 42, 43 closed, the connector 24 can continue to be compressed to fully crimp the connector on the conductors A–C. Thus, the connector 24 can be used to connect to both Class I and Class K stranded conductors.

Figure 5:
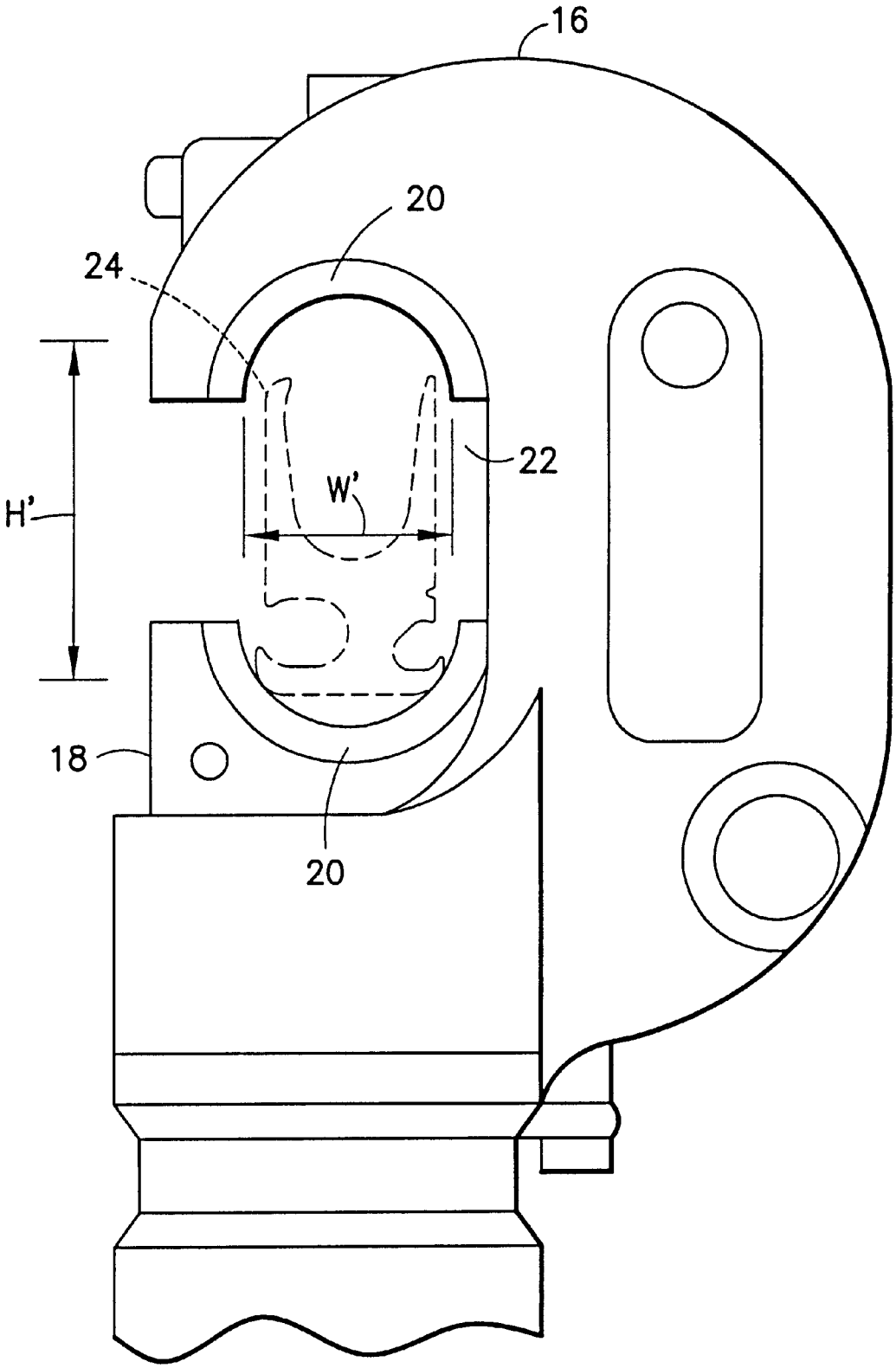
FIG. 5 is an enlarged elevational view of the crimping head of the tool shown in FIG. 1 with the connector shown in dotted lines.

Referring also to FIG. 5, another feature of the present invention will be described. As noted above, the dimensions H and W are preferably substantially the same as the conventional YH292C electrical compression connector. The YH292C connector is compressed or crimped by use of specific types of dies 20 in the tool 2, such as U dies or P dies sold by FCI USA Inc. (more specifically U654 dies for the Y750 tool and P654 dies for the Y46 tool)

There is a desire to allow Class K conductors to be connected by a compression connector, similar to the YH292C connector, which can use the same tool (such as a Y46 or Y750 tool) and the same dies (such as U654 dies or P654 dies) as have been used in the past to crimp the YH292C connector. However, the connector receiving area 22 between the dies 20 has a limited space. This presents a height H' and width W' limitation for any type of new connector if the same tool and dies are desired to be used. Thus, the overall size of the new connector could not merely be increased. If the new connector was too big, it could not fit within the connector receiving area 22. In addition, the body of the connector must comprise sufficient material and sufficient dimensions to prevent failure of the connector during crimping or compression, and still provide adequate electrical properties.

The connector 24 has been specifically designed to be usable with the same tool and dies as were used in the past to crimp the YH292C connector. Therefore, users do not need to buy a new tool or new dies. The same tool and dies used to crimped the YH292C connector can be used to crimp the connector 24 onto either Class I or Class K conductors. Although the size of the tap channels 38, 39 has been increased compared to the conventional YH292C connector, because of the cooperating nature of the bottom portions 46–47, the increase in size of the tap channels 38, 39 has been minimized. Thus, the body of the connector has sufficient material and sufficient dimensions to prevent failure of the connector during crimping and still provide adequate electrical properties.

The connector 24 was designed to accept flex conductors, such as Class K conductors, in the two different tap locations with each tap location having a different geometry. With the conventional YH292C compression connector it is impossible to contain all of the strands of a 4 AWG Class K conductor in the larger tap channel and an 8 AWG Class K conductor in the second smaller tap channel. The problem occurs during the compression stage. The conventional connector does not have enough volume in its tap channels to capture all of the strands of a flex conductor.

Because of this insufficient volume, the strands of the flex conductors have a tendency to want to fan out of the lateral side openings of the tap channels before the tap channel side openings can be completely closed. This creates a problem electrically due to the small percentage of strands actually contained in the tap channels. The new connector 24 uses two different types of tap channel geometries to capture two different size flex conductors. Another feature of this design is that the bottom of the connector has been widened to help capture the strands of a Class K flex conductor during compression. With the increase in tap channel volume, widening the bottom of the connector, and the tap channel geometry, this makes compression of flex conductors easier and more complete than the conventional connector. The new connector 24 is now capable of capturing larger size flex type Class K conductors as well as standard Class I conductors. The new design is easy to manufacture as an extrusion. The new design has a greater conductor range. The connector of the present invention also uses less material to manufacture. This results in a cost savings to the manufacturer.

Increasing the size of the tap channels alone, without also providing the extended feature of the bottom portions, could have resulted in a connector without sufficient material or dimensions to prevent failure during crimping or would provide inadequate electrical properties. In addition, the relatively small increase in the size of the width of the connector, due to the added distances $D_1$, is not large enough to prevent the connector 24 from being inserted into the dies 20. The shape of the bottom portions 46, 47 also helped to minimize the increase in size of the overall connector, but still allow quick closure of the lateral side apertures 42, 43.

Providing the extended feature of the bottom portions alone, without also providing an increased size of the tap channels, might have made the outer dimensions of the connector too big and might not have prevented strands of a Class K conductor from exiting the tap channel lateral side apertures because compression forces would be exerted against the tap conductors in the tap channels before the lateral side apertures closed. However, the combination of the increased size tap channels and the extended bottom portions produces an additive affect. These features combine to close the lateral side apertures to the tap channels before compression forces on the tap conductors attempt to push the tap conductors out of the lateral side apertures, but nonetheless allows the connector to have sufficient material and rigidity to withstand the crimping action of the crimping tool without a failure of the connector.

The compression tool 2 crimps the top and bottom sections 26, 28 onto the three conductors A, B and C at substantially a same time. Although the bottom portions 46, 47 are deformed to close the lateral side apertures 42, 43 at an early stage of the connector's crimping, the ends 58, 61 of the bottom portions contact the projections 52, 53. This temporarily stops or slows down further significant compression of the bottom section 28 until more significant deformation of the top section 26 occurs. The legs 34, 36 are crimped inward and downward towards the conductor A, and then the connector 24 is relatively evenly compressed onto the three conductors A, B and C. This prevents the connector 24 from piercing too deeply into the tap conductors B, C and potentially creating a bad crimp.

The connector 24 is particularly useful in the telecommunications industry for distribution of power by use of Class K conductors. The connector 24 can receive either a Class I or a Class K conductor in main run channel 30 and, can receive either a Class I and/or a Class K conductor in each of the respective two tap conductor channels 38, 39.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical compression connector comprising;

a first section having a first main conductor receiving channel extending into a top side of the connector; and a second section integrally formed with the first section, the second section having a first tap conductor receiving channel and a second tap conductor receiving channel extending into opposite respective first and second lateral sides of the connector, wherein the tap conductor receiving channels comprise different shapes and different cross sectional areas, wherein the second section comprises two bottom portions at bottoms of the tap conductor receiving channels which curve upward, wherein the two bottom portions extend laterally outward past top portions of the second section located at top sides of the tap conductor receiving channels.

2. An electrical compression connector comprising:

a first section having a first main conductor receiving channel extending into a top side of the connector; and a second section integrally formed with the first section, the second section having a first tap conductor receiving channel and a second tap conductor receiving channel extending into opposite respective first and second lateral sides of the connector, wherein the tap conductor receiving channels comprise different shapes and different cross sectional areas, wherein the first tap conductor receiving channel has a general oval shaped cross section, and wherein the second tap conductor receiving channel has a general wedge shaped cross section.

3. An electrical compression connector as in claim 2 wherein the first tap conductor receiving channel has a larger cross sectional size than the second tap conductor receiving channel.

4. An electrical compression connector as in claim 3 wherein the first tap conductor receiving channel has generally flat top and bottom surfaces.

5. An electrical compression connector as in claim 1 wherein the second tap conductor receiving channel has a general wedge shaped cross section.

6. An electrical compression connector as in claim 5 wherein the second tap conductor receiving channel has a bottom side and an upper, laterally outward facing oblique side which are generally flat.

7. An electrical compression connector as in claim 6 wherein the second tap conductor receiving channel has an outer lateral side with an aperture to the second lateral side of the connector.

8. An electrical compression connector as in claim 1 wherein the first section comprises a general "U" shape.

9. An electrical compression connector as in claim 1 wherein the first and second sections are integrally formed as an extruded member.

10. An electrical compression connector as in claim 1 wherein the second section comprises a substantially flat bottom surface.

11. An electrical compression connector as in claim 1 wherein the first tap conductor receiving channel is sized and shaped to fully crimped onto a 2 AWG size Class K conductor, wherein the second tap conductor receiving channel is sized and shaped to fully crimped onto an 8 AWG size Class K conductor, and wherein the second section is about 1 inch wide and, less than about 0.7 inch high.

12. An electrical compression connector comprising;

a first section having a first main conductor receiving channel extending into a top side of the connector; and a second section integrally formed with the first section, the second section having a first tap conductor receiving channel and a second tap conductor receiving channel extending into opposite respective first and second lateral sides of the connector, wherein the tap conductor receiving channels comprise different sizes, and wherein bottom portions of the second section extend laterally outward past lateral sides of the first section, and past lateral sides of top portions of the second section.

13. An electrical compression connector as in claim 12 wherein the first tap conductor receiving channel has a general oval shaped cross section.

14. An electrical compression connector as in claim 13 wherein the second tap conductor receiving channel has a general wedge shaped cross section.

15. An electrical compression connector as in claim 14 wherein the first tap conductor receiving channel has a larger cross sectional size than the second tap conductor receiving channel.

16. An electrical compression connector as in claim 12 wherein the second tap conductor receiving channel has a general wedge shaped cross section.

17. An electrical compression connector as in claim 16 wherein the second tap conductor receiving channel has a bottom side and an upper, outwardly facing oblique side which are generally flat.

18. An electrical compression connector as in claim 17 wherein the second tap conductor receiving channel has an outer lateral side with an aperture to the second lateral side of the connector.

19. An electrical compression connector comprising;

a first section having a first main conductor receiving channel extending into a top side of the connector; and a second section integrally formed with the first section, the second section having a first tap conductor receiving channel and a second tap conductor receiving channel extending into opposite respective first and second lateral sides of the connector, wherein lateral sides of bottom portions of the second section extend laterally outward past outermost lateral sides of the second section, wherein the first tap conductor receiving channel is sized and shaped to be fully crimped onto a 2 AWG size Class K conductor, wherein the second tap conductor receiving channel is sized and shaped to be fully crimped onto an 8 AWG size Class K conductor, and wherein the second section is about 1 inch wide and, less than about 0.7 inch high.

* * * * *